US008620175B2

(12) United States Patent
Nakano et al.

(10) Patent No.: US 8,620,175 B2
(45) Date of Patent: Dec. 31, 2013

(54) IMAGE FORMING APPARATUS

(71) Applicants: Hiroshi Nakano, Aichi (JP); Shougo Sato, Seto (JP)

(72) Inventors: Hiroshi Nakano, Aichi (JP); Shougo Sato, Seto (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/921,315

(22) Filed: Jun. 19, 2013

(65) Prior Publication Data

US 2013/0279959 A1 Oct. 24, 2013

Related U.S. Application Data

(63) Continuation of application No. 13/074,718, filed on Mar. 29, 2011, now Pat. No. 8,494,408.

(30) Foreign Application Priority Data

May 27, 2010 (JP) ..... 2010-121924

(51) Int. Cl.
*G03G 15/16* (2006.01)

(52) U.S. Cl.
USPC ..... 399/101; 399/120; 399/360

(58) Field of Classification Search
USPC ..... 399/101, 120, 360
See application file for complete search history.

(56) References Cited

U.S. PATENT DOCUMENTS

| | | | | |
|---|---|---|---|---|
| 2006/0110195 | A1* | 5/2006 | Fuji et al. | 399/360 |
| 2007/0009295 | A1 | 1/2007 | Kadowaki et al. | |
| 2007/0110458 | A1 | 5/2007 | Inoue et al. | |
| 2008/0187378 | A1 | 8/2008 | Lim | |
| 2009/0092429 | A1 | 4/2009 | Yokota | |
| 2009/0226205 | A1* | 9/2009 | Sato et al. | 399/101 |
| 2009/0269112 | A1* | 10/2009 | Fukunaga et al. | 399/360 |
| 2011/0236055 | A1 | 9/2011 | Mori et al. | |
| 2011/0236056 | A1 | 9/2011 | Mori et al. | |
| 2011/0293316 | A1 | 12/2011 | Sato | |
| 2011/0293318 | A1 | 12/2011 | Nakano et al. | |
| 2012/0113441 | A1 | 5/2012 | Hama et al. | |

FOREIGN PATENT DOCUMENTS

| | | | |
|---|---|---|---|
| JP | 10-039566 | A | 2/1998 |
| JP | 2004-279919 | A | 10/2004 |
| JP | 2007-140144 | A | 6/2007 |

OTHER PUBLICATIONS

Notice of Allowance dated Mar. 26, 2013 from related U.S. Appl. No. 13/074,718.

* cited by examiner

*Primary Examiner* — G. M. Hyder
(74) *Attorney, Agent, or Firm* — Scully, Scott, Murphy & Presser, PC

(57) ABSTRACT

An image forming apparatus is provided. The image forming apparatus includes a chassis, a cover, photosensitive members, an intermediate transfer belt, primary-transfer members, a secondary-transfer roller, a first feed roller, a cleaner device, a waste toner container, which is movable along the predetermined direction to be removably installed in the chassis through a first opening and stores residual toner, a connector, a first feeding path, a second feeding path being a path for a recording sheet inserted through a sheet inlet and includes a sheet guide to guide the recording sheet, and a second feed roller. The second feed roller is movable along with at least a part of the sheet guide. The waste toner container is movable through space, which is occupied by the second feed roller in an upper position, and the first opening when the second feed roller is in a lower position.

20 Claims, 9 Drawing Sheets

IMAGE FORMING APPARATUS

CROSS REFERENCE TO RELATED APPLICATION

This application is a continuation application of U.S. Ser. No. 13/074,718 filed on Mar. 29, 2011 and claims priority from Japanese Patent Application No. 2010-121924, filed on May 27, 2010, the entire subject matter of each of which are incorporated herein by reference.

BACKGROUND

1. Technical Field

An aspect of the present invention relates to an image forming apparatus, specifically having an intermediate transfer belt, to which a toner image is transferred from one or more photosensitive members, and a waste toner container, which stores residues such as residual toner removed from the intermediate transfer belt.

2. Related Art

An image forming apparatus having a waste toner container, in which residual toner collected from an intermediate transfer belt is stored, is known. The waste toner container may be arranged below the intermediate transfer belt and removed therefrom through an opening, which is formed on a side surface of a chassis of the image forming apparatus. The image forming apparatus may have a secondary-transfer roller, which serves in cooperation with the intermediate transfer belt to transfer a toner image formed on a surface of the belt to a sheet of paper, and a feed roller, which feeds the sheet from a sheet tray in a feeding path to a nipped position between the intermediate transfer belt and the secondary-transfer roller. The secondary-transfer roller and the feed roller may be arranged in positions on a side opposite from the opening for the waste toner container. Therefore, in such configuration, the feeding path extending from an outlet of the sheet tray to the secondary-transfer roller may be formed on the side opposite from the chassis opening.

SUMMARY

Meanwhile, an image forming apparatus may be configured to have an external-sheet inlet, through which externally-supplied sheets are manually inserted. With the external-sheet inlet, it is preferable that an opening for the inlet is formed on the same side as the opening for installation and removal of the waste toner container for convenience of handling and placement of the image forming apparatus. Further, in such a configuration, a feed roller to convey the externally-supplied sheets is required to be arranged in the vicinity of the sheet-inlet opening.

When the feed roller is arranged in the vicinity of the opening for the waste toner container, however, the feed roller may undesirably interfere with the waste toner container being removed from or installed in the image forming apparatus through the opening, which is in the vicinity of the sheet-inlet opening.

In view of the above drawbacks, the present invention is advantageous in that an image forming apparatus having an opening for installation and removal of the waste toner container and the feed roller for externally-supplied sheets on the same side, in which the waste toner container can be installed and removed easily, is provided.

According to an aspect of the present invention, an image forming apparatus to form an image on a recording sheet is provided. The image forming apparatus includes a chassis having a first opening, which is formed on a first side of the chassis, a cover, which is movable between an open position and a closed position to expose and close the first opening, a plurality of photosensitive members, which are set in the chassis and carry toner images, an intermediate transfer belt, which is an endless rolling belt arranged to have a surface thereof facing the plurality of photosensitive members and to have the toner images on the plurality of photosensitive members transferred onto the surface in cooperation with a plurality of primary-transfer members, a secondary-transfer roller, which is arranged on a second side opposite from the first side within the chassis and transfers the toner images on the surface of the intermediate transfer belt onto the recording sheet, a first feed roller, which is arranged in vicinity of the second side and conveys the recording sheet in a feeding path toward the secondary-transfer roller, a cleaner device, which is arranged in a position between one of the plurality of photosensitive members being in a most upstream position along a rolling direction of the intermediate transfer belt and the secondary-transfer roller, to collect residual toner from the surface of the intermediate transfer belt, a waste toner container, which is movable along a predetermined direction to be removably installed in the chassis through the first opening and settled in a position opposite from the plurality of photosensitive members across the intermediate transfer belt, to store the residual toner collected by the cleaner device, a connector, which is connected to the cleaner device, and to which the waste toner container is detachably attached, to convey the residual toner collected by the cleaner device to the waste toner container, a first feeding path, which extends in a range between the first feed roller and the secondary-transfer roller, a second feeding path, which is a path for a recording sheet being inserted through a sheet inlet, the sheet inlet being formed on the first side of the chassis, and merges into the first feeding path in the vicinity of the first feed roller, and a second feed roller, which is arranged in a position closer to the first side of the chassis with respect to the waste toner container within the second feeding path and in an overlapping position at least partially with the waste toner container along the predetermined direction of installation and removal of the waste toner container. The second feeding path includes a sheet guide to guide the recording sheet. The second feed roller is movable between an upper position and a lower position along with at least a part of the sheet guide. The waste toner container is movable through space, which is occupied by the second feed roller in the upper position, and the first opening when the second feed roller is in the lower position.

According to another aspect of the present invention, an image forming apparatus to form an image in toner on a recording sheet being conveyed in a feeding path is provided. The image forming apparatus includes a chassis having an opening formed on one side thereof, a waste toner container, which is movable along a predetermined direction to be removably installed in the chassis through the opening and stores residual toner, a sheet inlet, which is formed on the one side of the chassis, and through which the recording sheet is fed in the feeding path, and a feed roller, which is arranged in a position closer to the one side of the chassis with respect to the waste toner container within the feeding path and in an overlapping position at least partially with the waste toner container along the predetermined direction of installation and removal of the waste toner container, wherein the feeding path includes a sheet guide, which guides the recording sheet in the feeding path. The feed roller is movable vertically between an upper position and a lower position along with at least a part of the sheet guide in the feeding path. The waste toner container is movable through space, which is occupied by the feed roller in the upper position, and the opening when the feed roller is in the lower position.

BRIEF DESCRIPTION OF THE ACCOMPANYING DRAWINGS

DETAILED DESCRIPTION

Hereinafter, an embodiment according to an aspect of the present invention will be described with reference to the accompanying drawings.

[Overall Configuration of the MFP]

The MFP 1 is a multicolor-enabled MFP, equipped with a plurality of image processing functions including a scanning function, a printing function, a copier function, a facsimile transmission/receiving function, and a function for reading/writing data in a memory medium.

Figure 1:
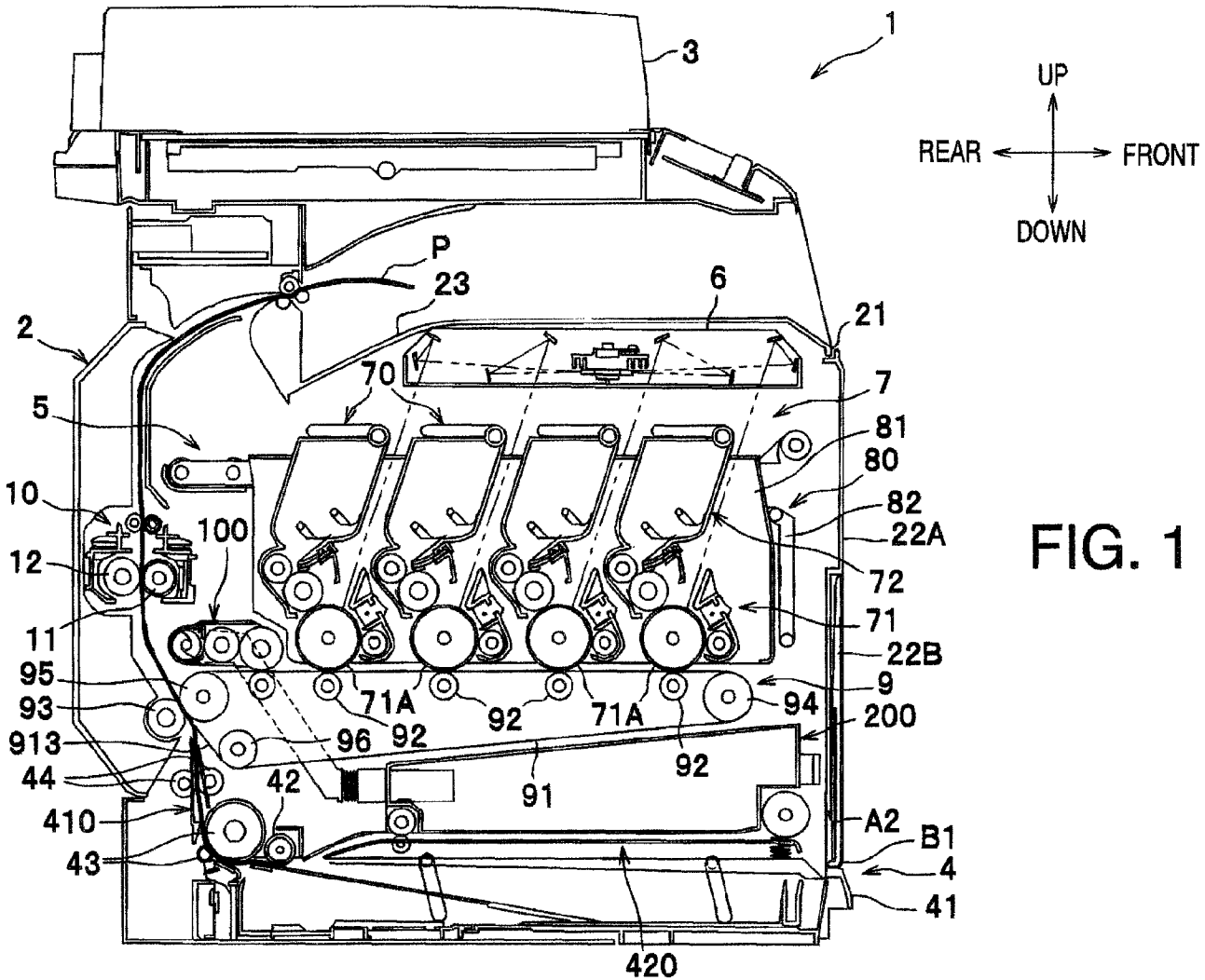
FIG. 1 is a cross-sectional side view of a multicolor MFP (multi-function peripheral) according to an embodiment of the present invention.
Figure 2:
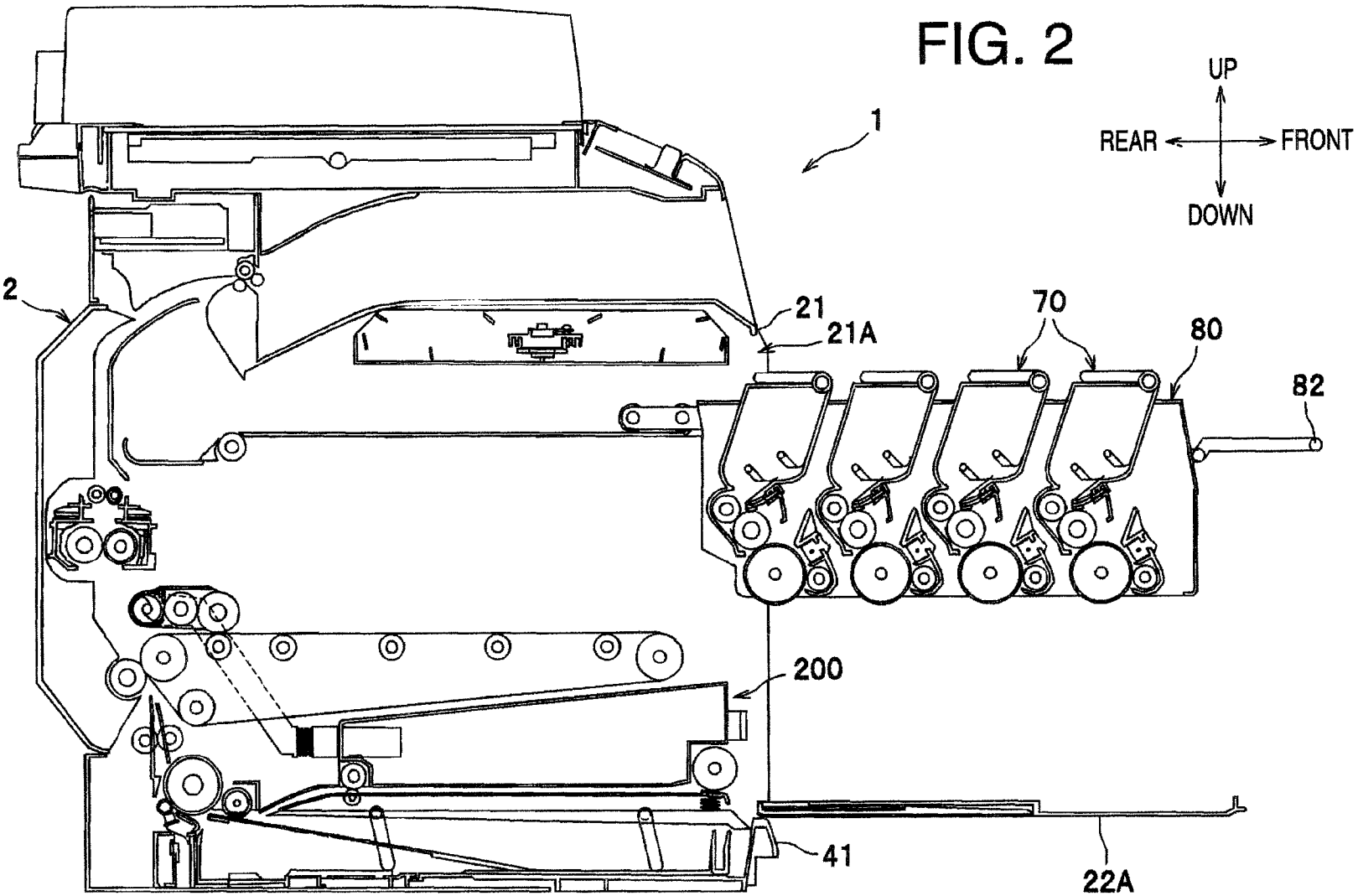
FIG. 2 is a cross-sectional side view of the MFP with a drawer drawn out of a chassis of the MFP according to the embodiment of the present invention.
Figure 3:
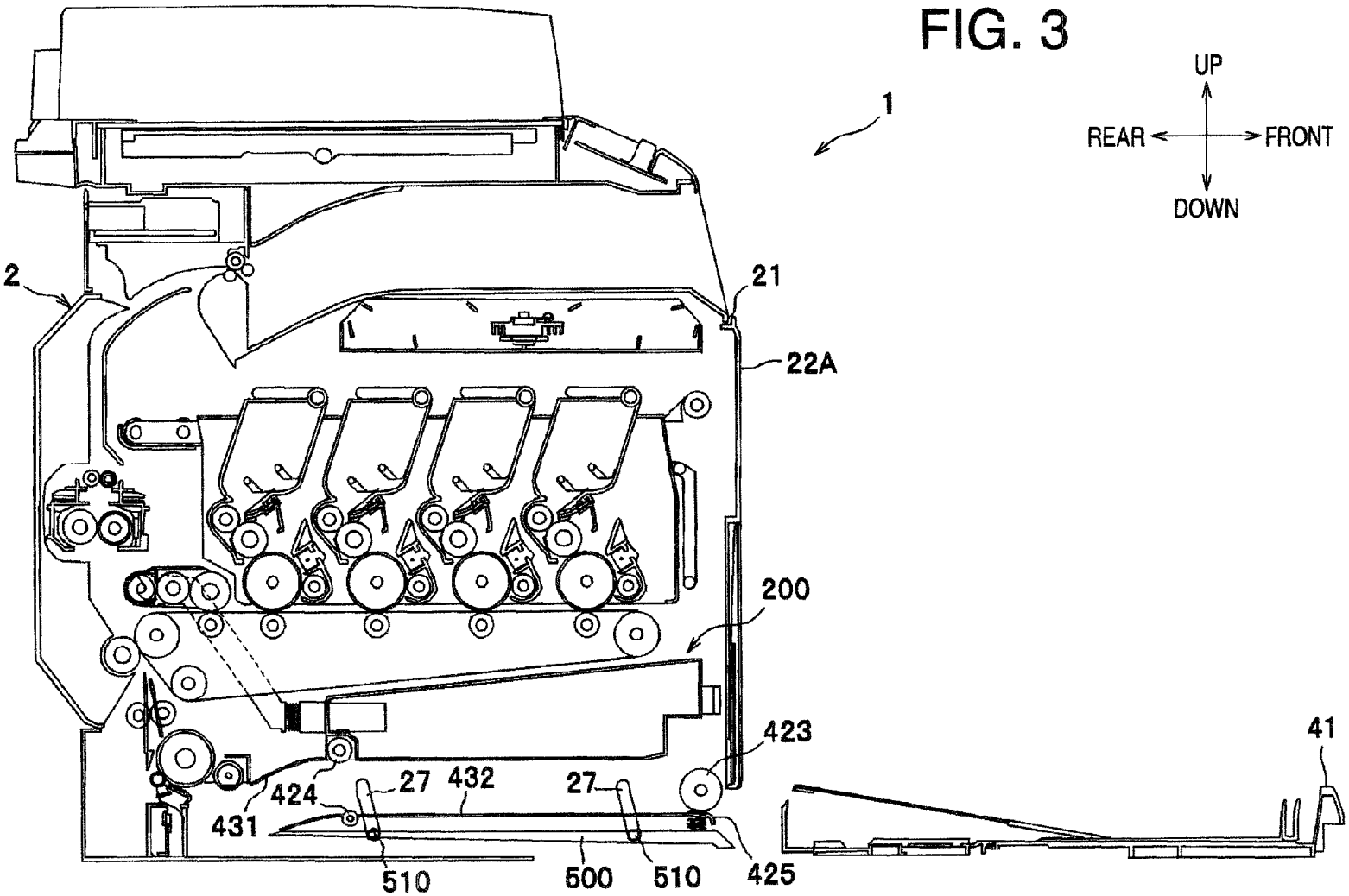
FIG. 3 is a cross-sectional side view of the MFP with a sheet-feed tray removed out of the chassis of the MFP according to the embodiment of the present invention.

In the present embodiment, directions concerning the MFP 1 will be referred to in accordance with orientation as indicated by arrows in each drawing. Therefore, for example, a viewer's right-hand side appearing in FIG. 1 is referred to as a front side of the MFP 1, and left-hand side in FIG. 1 opposite from the front side is referred to as rear. A side which corresponds to the viewer's nearer side is referred to as left, and an opposite side from the left, which corresponds to the viewer's further side is referred to as right. The up-down direction in FIG. 1 corresponds to a vertical direction of the MFP. Further, directions of the drawings in FIGS. 2-8 are similarly based on the orientation of the MFP 1 as defined above and correspond to those with respect to the MFP 1 shown in FIG. 1 even when the drawings are viewed from different angles. In cross-sectional views in the accompanying drawings, hatchings are omitted unless specifically required in order to simplify the illustration.

The MFP 1 according to the embodiment includes a chassis 2 and a flatbed scanner 3, which is arranged on top of the chassis 2. The MFP 1 further has a sheet-feed unit 4, which feeds recording sheets P of paper in a sheet feeding path, and an image forming unit 5, which forms images on the sheets P being fed, inside the chassis 2.

The chassis 2 is formed to have an opening 21A (see FIGS. 2 and 4) on a front side 21 thereof. The opening 21A is an opening, through which a drawer 80 to hold processing cartridges 70 and a waste toner container 200 are installed in and removed from the chassis 2. The opening 21A is covered by a front cover 22A, which is rotatable about a lower edge A1 (see FIG. 5) thereof between an open position (see FIG. 1) and a closed position (see FIG. 2) to cover and expose the opening 21A.

The front cover 22A is arranged in an upper position with respect to a sheet-feed tray 41. Further, the front cover 22A is formed to have a bottom-open rectangular-shaped smaller opening A2, which is open-ended at the lower edge A1.

The smaller opening A2 in the front cover 22A can be covered by an external feed tray 22B. The external feed tray 22B is a sheet tray, on which unused sheets P to be manually fed in the sheet feeding path are set. The external feed tray 22B is rotatable about a rotation axis B2 with respect to the front cover 22A to cover and uncover the smaller opening A2. The rotation axis B2 of the external feed tray 22B extends in a slightly higher position with respect to a lower edge B1 of the external feed tray 22B; therefore, when the external feed tray 22B is opened (see FIG. 5), the lower edge B1 of the external feed tray 22B is drawn inside the chassis 2. Further, when the external feed tray 22B is in an open position, an upper surface of the external feed tray 22B (i.e., an inner surface when closed), a right-side edge, a left-side edge, and an upper edge of the smaller opening A2 serve as an external-sheet inlet 421. The sheet P manually inserted through the external-sheet inlet 421 is conveyed in a second feeding path 420, which directs the sheet P to a first feed roller 42. The second feeding path 420 and the first feed roller 42 will be described later in detail.

The flatbed scanner 3 (see FIG. 1) arranged on top of the chassis 2 is a known document reader, which irradiates light onto a source document to read an image formed thereon and creates image data representing the read image.

The sheet-feed unit 4 is arranged in a lower section of the chassis 2. The sheet-feed unit 4 includes the sheet-feed tray 41, the first feed roller 42, a separator roller 43, and a conveyer roller 44. The sheet-feed tray 41 is removably installed in the chassis 2, through a lower section with respect to the front cover 22A, in a lower position with respect to the second feeding path 420.

The sheet-feed tray 41 is a container to store unused sheets P. The first feed roller 42 is arranged in an upper-rear position with respect to the sheet-feed tray 41 and picks up the sheets P from the sheet-feed tray 41. The sheets P having been picked up by the first feed roller 42 are separated by the separator roller 43 and conveyed upwardly by the conveyer roller 44 one-by-one to a position between an intermediate transfer belt 91 and a secondary transfer roller 93 in the image forming unit 5.

The image forming unit 5 includes an exposure unit 6, a photosensitive developer unit 7, a belt unit 9, and a fixing unit 10.

The exposure unit 6 is arranged in an upper section in the chassis 2 and includes a laser-beam source (unsigned), a polygon mirror, a lens, and a reflection mirror (not shown). Laser beams emitted from the laser-beam source for yellow, cyan, magenta, and black colors are reflected on the polygon mirrors and the reflection mirrors and transmit through the lenses to be casted to scan on surfaces of photosensitive drums 71A. Double-dotted lines shown in FIG. 1 represent paths of the laser beams.

The photosensitive developer unit 7 is arranged in a lower section with respect to the exposure unit 6 and a higher section with respect to the belt unit 9. The photosensitive developer unit 7 includes four (4) processing cartridges 70, which are aligned in line in a front-rear direction, and a drawer 80, which detachably holds the processing cartridges 70.

Each of the processing cartridges 70 has a drum cartridge 71 in a lower section and a developer cartridge 72, which is detachably attached to a top section of the drum cartridge 71.

The drum cartridge 71 includes a photosensitive drum 71A and a charger (unsigned). Whilst four (4) drum cartridges 71 are aligned in line in the front-rear direction, four (4) photosensitive drums 71A are also aligned in line in the front-rear direction.

Each of the developer cartridges 72 is equipped with a developer roller, a supplier roller, and a toner container (unsigned). Each toner container contains nonmagnetic monocomponent toner in one of cyan, magenta, yellow, and black colors.

The drawer 80 includes a main frame 81, which holds the processing cartridges 70, and a rotatable handle 82, which is arranged on a front side of the main frame 81. The drawer 80 is slidable in the chassis 2 in the front-rear direction to be installed in and removed from the chassis 2 through the opening 21A (see FIG. 2). In particular, the drawer 80 is movable between an installed position, in which the entire drawer 80 is settled in the chassis 2 (see FIG. 1), and a removed position, in which the drawer 80 is removed out of the chassis 2 (see FIG. 2).

In the photosensitive developer unit 7 configured as above, the charger electrically charges a surface of the photosensitive drum 71A evenly, and the surface of the photosensitive drum 71A is exposed to the laser beam emitted based on image data from the exposure unit 6 in order to form a lower-potential regions, i.e., an electrostatic latent image, thereon.

Meanwhile, the toner in the developer cartridge 72 is supplied to the latent image on the photosensitive drum 71A via the supplier roller and the developer roller. Thus, the latent image is developed to be a toner image carried on the surface of the photosensitive drum 71A.

The belt unit 9 is arranged in a lower position with respect to the photosensitive developer unit 7 and includes an intermediate transfer belt 91, four (4) primary-transfer rollers 92, a secondary-transfer roller 93, a driving roller 94, and two (2) driven rollers 95, 96. In particular, the driven roller 96 is arranged in a rear section of the chassis 2 and in a vertically overlapping position with the driven roller 95. The MFP 1 has a cleaner device 100 and a waste toner container 200, which will be described later in detail, in positions in the vicinities of the belt unit 9.

The intermediate transfer belt 91 is an endless belt extended to roll around rollers 94, 95, 96, which are arranged in a shape of a flat-triangular wedge when viewed from a side, in a clockwise direction in FIGS. 1-5 and FIG. 6A. More specifically, the intermediate transfer belt 91 has a first plane 911, which extends between the driving roller 94 being a front end portion and the driven roller 95 being a rear end portion horizontally to face the photosensitive drums 71A and the cleaner device 100, a second plane 912, which extends from the front end portion (i.e., the driving roller 94) of the first plane 911 downwardly in an inclined angle (e.g., toward lower left) to the driven roller 96, and a third plane 913, which extends from the rear end portion (i.e., the driven roller 95) of the first plane 911 downwardly in an inclined angle (e.g., toward lower right) to meet a rear end portion (i.e., the driven roller 96) of the second plane 912 (see FIG. 6A). Specifically, the second plane 912 is in contact with the driven roller 96, which is in the rear section of the chassis 2, and extends from the rear section of the chassis 2 in an upward-inclined angle to a section in a vicinity of the front side 21 of the chassis 2.

The intermediate transfer belt 91, the first feed roller 42, and other sheet-feeding components such as a sheet guide (unsigned) are arranged in predetermined positions to have the sheet P conveyed by the first feed roller 42 to become in contact with the third plane 913 of the intermediate transfer belt 91 (see FIG. 1). The sheet P being in contact with the third plane 913 is conveyed by the rolling movement of the intermediate transfer belt 91 along the third plane 913 to a nipped position between the driven roller 95 and the secondary-transfer roller 93. When the sheet P is not carried along the third plane 913 but is carried in a path apart from the intermediate transfer belt 91 until the sheet P becomes in the vicinity of the secondary-transfer roller 93, electricity may be discharged between the third plane 913 of the intermediate transfer belt 91 and the sheet P. However, in the present embodiment, the discharge of electricity can be reduced due to the sheet P being in contact with the intermediate transfer belt 91 at the third plane 913.

The primary-transfer rollers 92 are arranged in positions to oppose the photosensitive drums 71A with the intermediate transfer belt 91 intervening therebetween and in contact with an upper internal surface of the intermediate transfer belt 91. The secondary-transfer roller 93 is arranged on a side opposite from the opening 21A within the chassis 2 in a position to oppose the secondary-transfer roller 93 via the rear end portion of the intermediate transfer belt 91. When the toner images are transferred to the surface of the intermediate transfer belt 91 and to the sheet P, transfer bias which enables the image transfer is applied to the primary-transfer rollers 92 and the secondary-transfer roller 93 respectively.

In particular, the toner images formed on the photosensitive drums 71A in four colored toners are primarily transferred onto an upper external surface in the first plane 911 of the intermediate transfer belt 91 in layers in cooperation with the rotating primary-transfer rollers 92 and the applied transfer bias. The toner images formed in colors on the intermediate transfer belt 91 are secondarily transferred onto the sheet P when the sheet P is conveyed through the section between the intermediate transfer belt 91 and the secondary-transfer roller 93 in cooperation with the rotating secondary roller 93 and the applied transfer bias.

The fixing unit 10 is arranged in an upper position with respect to the secondary-transfer roller 93 and includes a heat roller 11 and a pressure roller 12, which is in a position opposite from the heat roller 11, to press the heat roller 11.

The sheet P with the transferred toner images is carried to a nipped section between the heat roller 11 and the pressure roller 12 in the fixing unit 10 to have the toner images thermally fixed thereon. The sheet P with the fixed image is ejected out of the chassis 2 by discharge rollers (unsigned) and settled in a discharge tray 23.

[Configuration and Surroundings of the Waste Toner Container]

Configuration of the waste toner container 200 and surroundings thereof will be described in detail.

The cleaner device 100 (see FIG. 6A), which is connected to the waste toner container 200 by a connector 300 (described later) will be described. The cleaner device 100 is to remove residual toner remaining on the intermediate transfer belt 91 after the image transfer. The cleaner device 100 is arranged in a position between one of the photosensitive drums 711, which is in a most upstream position along a direction of rolling for the intermediate transfer belt 91, and the secondary-transfer roller 93. The cleaner device 100 includes a case 140 accommodating a cleaning roller 110, a collecting roller 120, and an auger 130.

The cleaning roller 110 rotates on the upper external surface of the intermediate transfer belt 91 to remove the residual toner from the surface. In particular, the cleaning roller 110 removes the residual toner in cooperation with a backup roller 111, which is arranged in an opposite position across the intermediate transfer belt 91, with predetermined bias applied to the cleaning roller 110 toward the backup roller 111.

The removed residual toner is passed to the collecting roller 120 as the collecting roller 120 and the cleaning roller 110 rotate. The collecting roller 120 is a roller arranged to have a circumference thereof to be in contact with a circumference of the cleaning roller 110. The collected residual toner is scraped off from the circumference of the collecting roller 120 by a blade (unsigned) and forwarded to an auger room 141, which accommodates the auger 130.

Figure 6A:
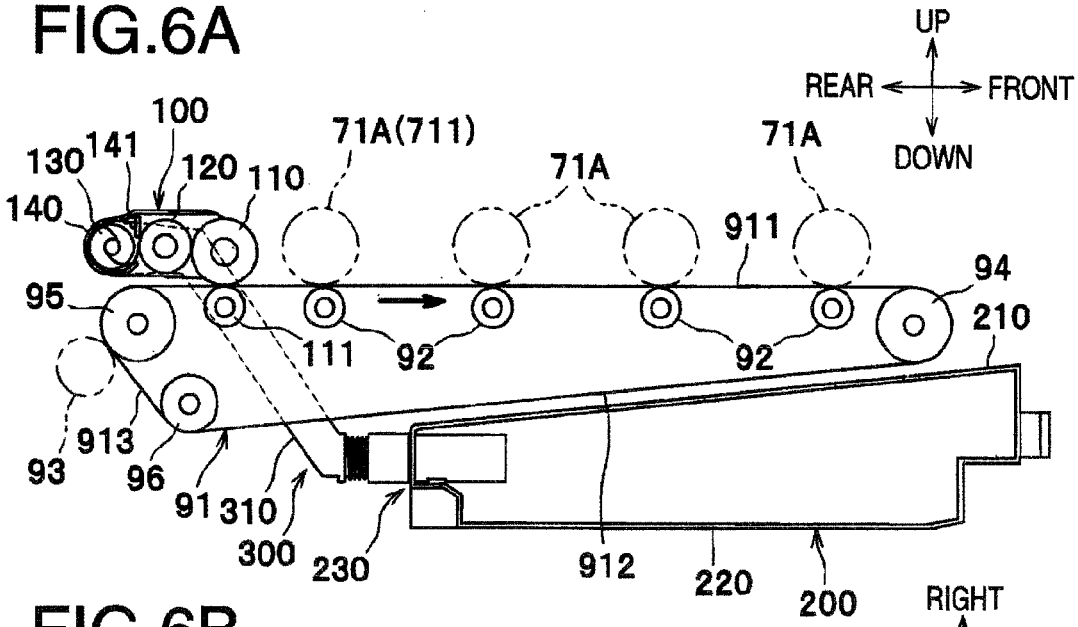
FIGS. 6A and 6B are an illustrative side view and a top plane view of an intermediate transfer belt, a cleaner device, a connector, and the waste toner container in the MFP according to the embodiment of the present invention.
Figure 6B:
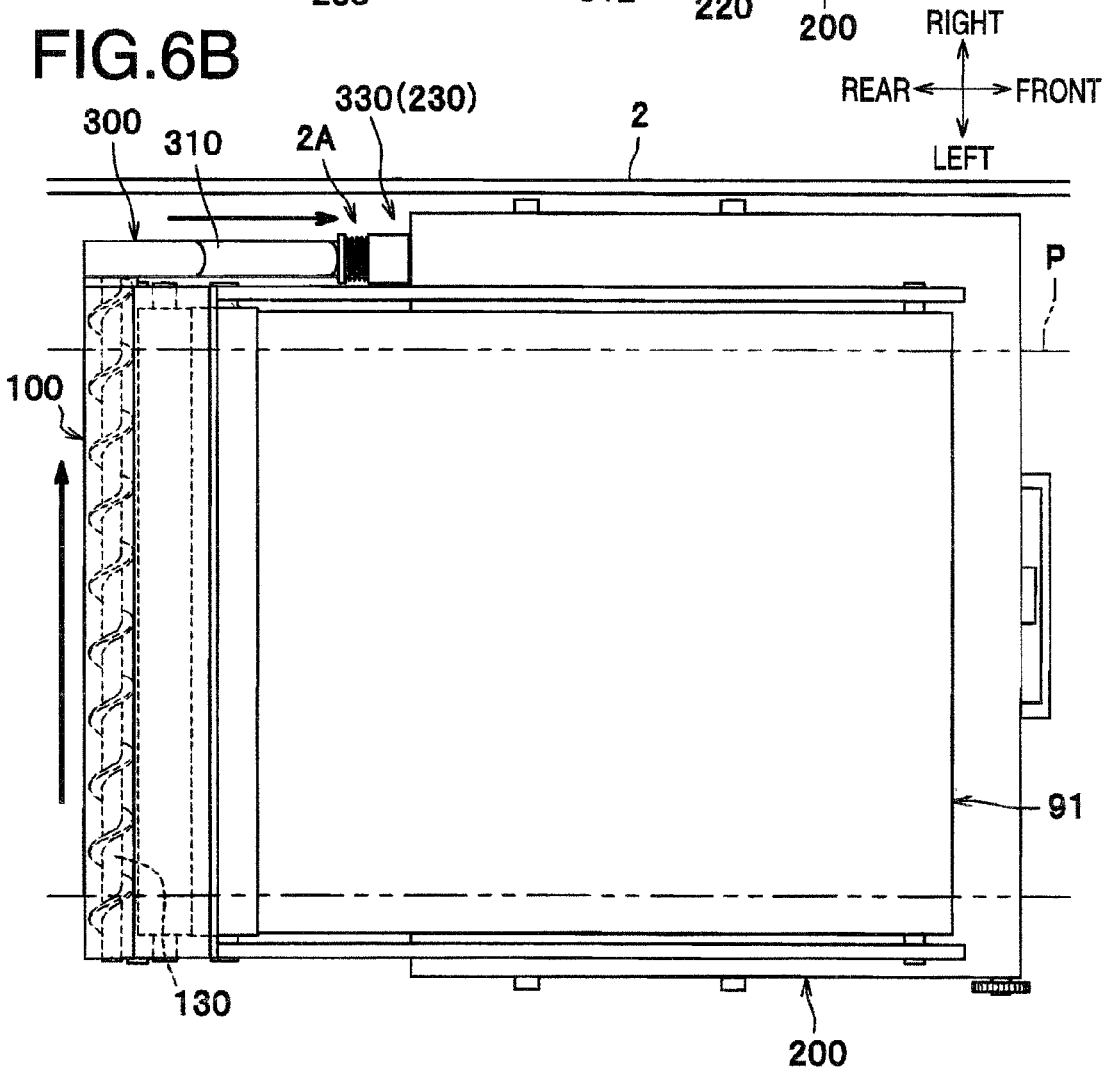
Figure 7A:
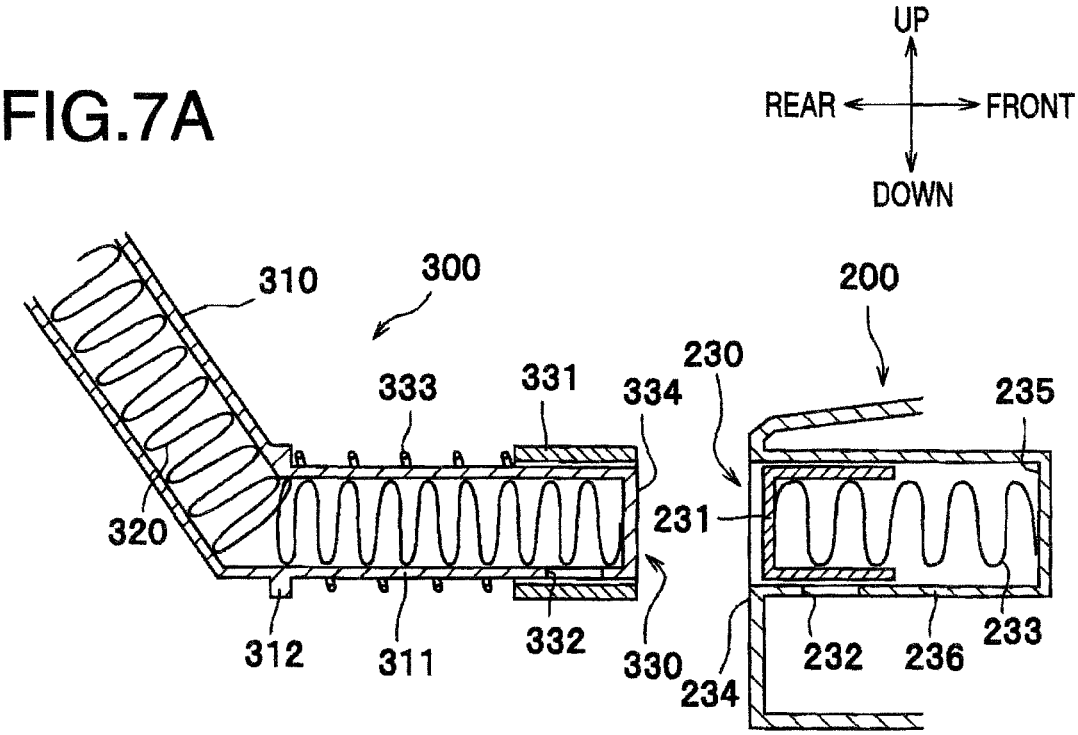
FIG. 7A is a cross-sectional side view of the connector detached from the waste toner container in the MFP according to the embodiment of the present invention.
Figure 7B:
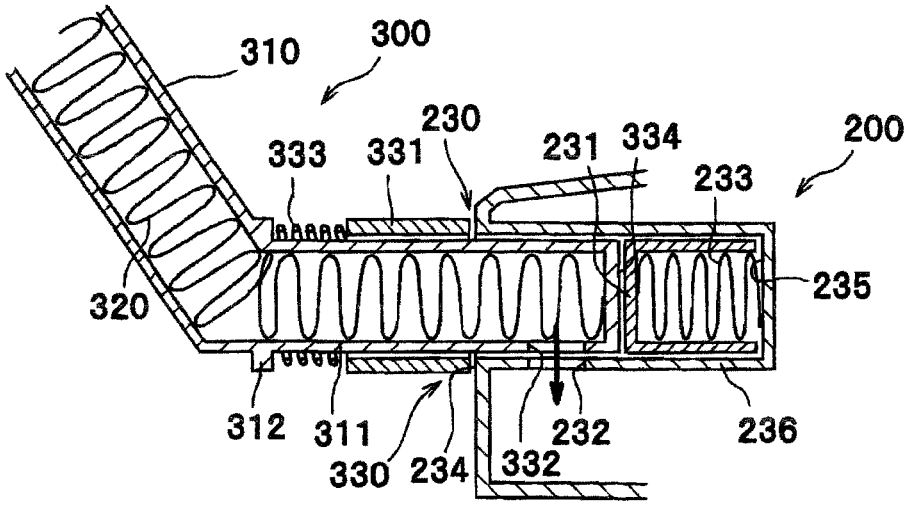
FIG. 7B is a cross-sectional side view of the connector attached to the waste toner container in the MFP according to the embodiment of the present invention.
Figure 8A:
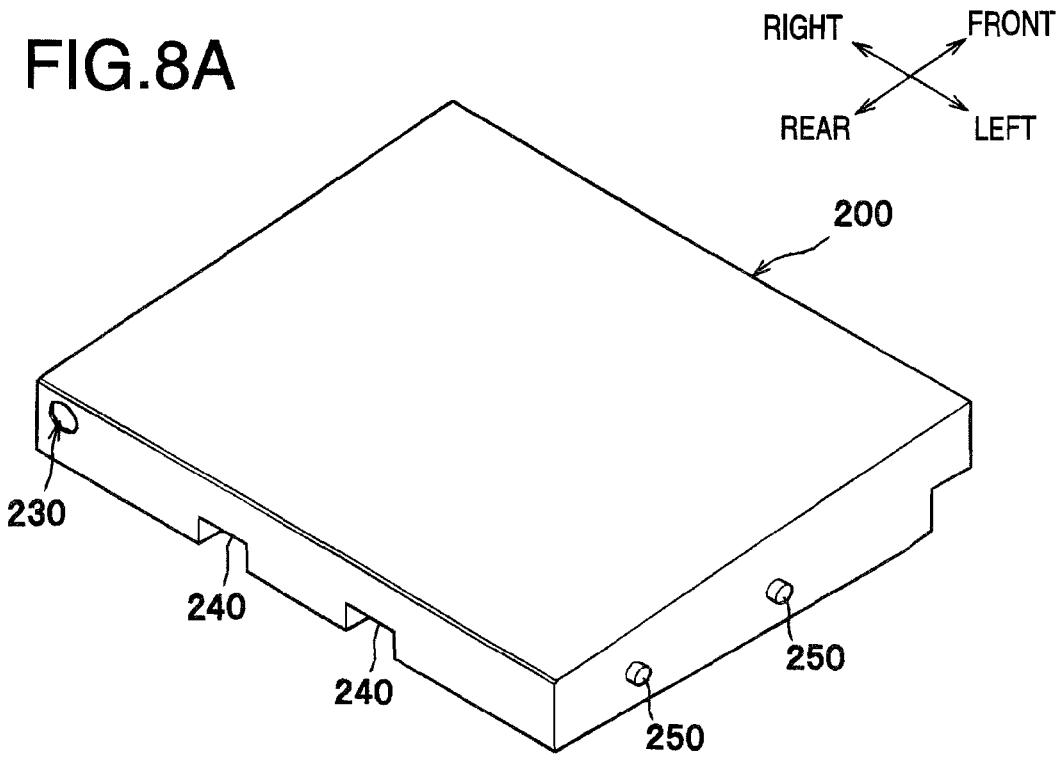
FIG. 8A is a perspective view of the waste toner container from top in the MFP according to the embodiment of the present invention.
Figure 8B:
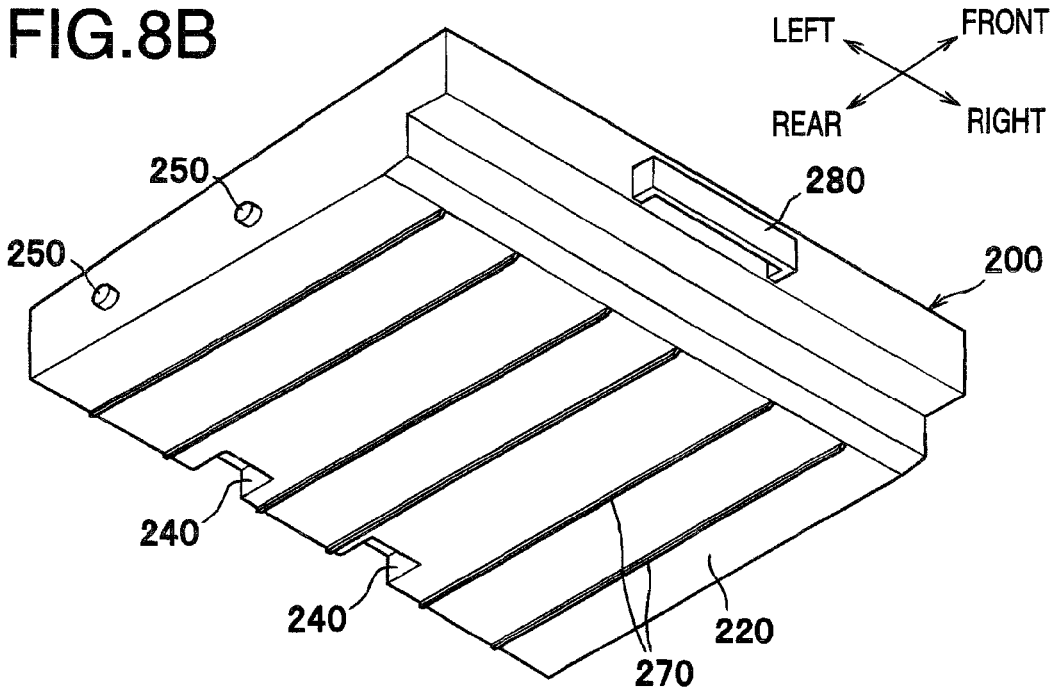
FIG. 8B is a perspective view of the waste toner container from bottom in the MFP according to the embodiment of the present invention.

The auger 130 is a roller having a spiral twining around a shaft (see FIG. 6B). As the auger 130 rotates about the shaft, the residual toner collected in the auger room 141 is carried outside one of widthwise (i.e., the right-left direction) ends of the intermediate transfer belt 91. In the present embodiment, the auger 130 carries the residual toner rightward. The toner carried rightward by the auger 130 is forwarded to the waste toner container 200 via a connector 300. The flow of the collected toner is indicated by thick arrows shown in FIG. 6B.

The connector 300 (see FIGS. 7A and 7B) connecting the cleaning device 100 with the waste toner container 200 will be described. The connector 300 is a pipe, which is connected to the cleaner device 100 at one end and to which the waste toner container 200 is detachably attached at the other end. The connector 300 includes a shell 310 being a pipe, which is arranged on a left side of the intermediate transfer belt 91 in clearance 2A between the widthwise end of the intermediate transfer belt 91 and the chassis 2. The connector 300 further includes a spring auger 320, which is arranged inside the shell 310 and rotatable within the shell 310 to convey the toner in an axial direction.

The connector 300 includes a connector joint 330 at a front end portion of the shell 310. The joint 330 is attachable to a receptacle joint 230 of the waste toner container 200 when the waste toner container 200 is installed in the chassis 2. Thus, the joints 230, 330 are mutually attachable and arranged in positions to align in the front-rear direction to face each other when the waste toner container 200 is inserted through the opening 21A and pushed inward to be completely installed.

The joints 230, 330 are provided with sealers 231, 331 respectively, which are slidable in the direction of installation and removal of the waste toner container 200 to cover and uncover openings 232, 332 formed in the waste toner container 200 and the shell 310. The sealers 231, 331 are pushed in the positions to cover the openings 232, 332 by resiliency of coil springs 233, 333. When the waste toner container 200 is attached to the connector 300, the sealers 231, 331 are pushed frontward and rearward respectively by a rear end edge 234 of the waste toner container 200 and a front end surface 334 of the connector 300 against the resiliency of the coil springs 233, 333.

More specifically, the sealer 331 of the connector 300 is a cylindrical sleeve and slidable in the front-rear direction with respect to a circumference 311 of the shell 310. Meanwhile, the sealer 231 of the waste toner container 200 is formed to have a cylinder with a closed rear end. The sealer 231 is arranged in a pit 235 formed in a rear-end section of the waste toner container 200 with an open end thereof facing front and slidable in the front-rear direction with respect to the waste toner container 200 within the pit 235. The opening 332 of the connector 300 is formed in a bottom part of the circumference 311 of the shell 310. The opening 232 of the waste toner container 200 is formed in a bottom part of a circumference 236 of the pit 235. The openings 232, 332 are formed in positions to coincide with each other when the waste toner container 200 is attached to the connector 300.

The coil spring 333 of the connector 300 is arranged in a position between the sealer 331 and an annular flange 312, which is formed to protrude outward from the outer circumference 311 of the shell 310. The coil spring 233 of the waste toner container 200 is arranged between a closed end of the sealer 231 and a closed end of the pit 235. The front end surface 334 of the shell 310 defines a front end surface of the shell 310 and accommodated within an inner diameter of the sealer 331. The rear end edge 234 of the pit 235 in the waste toner container 200 is formed to surround the sealer 231.

When the waste toner container 200 is attached to the connector 300, the sealer 331 is pushed rearward by the rear end edge 234 against the expandable force of the coil spring 333. At the same time, the sealer 231 is pushed frontward by the front end surface 334 of the shell 310 against the expandable force of the coil spring 233. Accordingly, the opening 332 of the connector 300 and the opening 232 of the waste toner container 200 coincide with each other to be connected (see FIG. 7B), and the collected toner is allowed to pass through the openings 332, 232 to be carried to the waste toner container 200.

The joints 230, 330 are arranged in a position outside width (length in the right-left direction) of the sheet P being carried in a second feeding path 420 (see FIG. 6B), which will be described later in detail.

Figure 4:
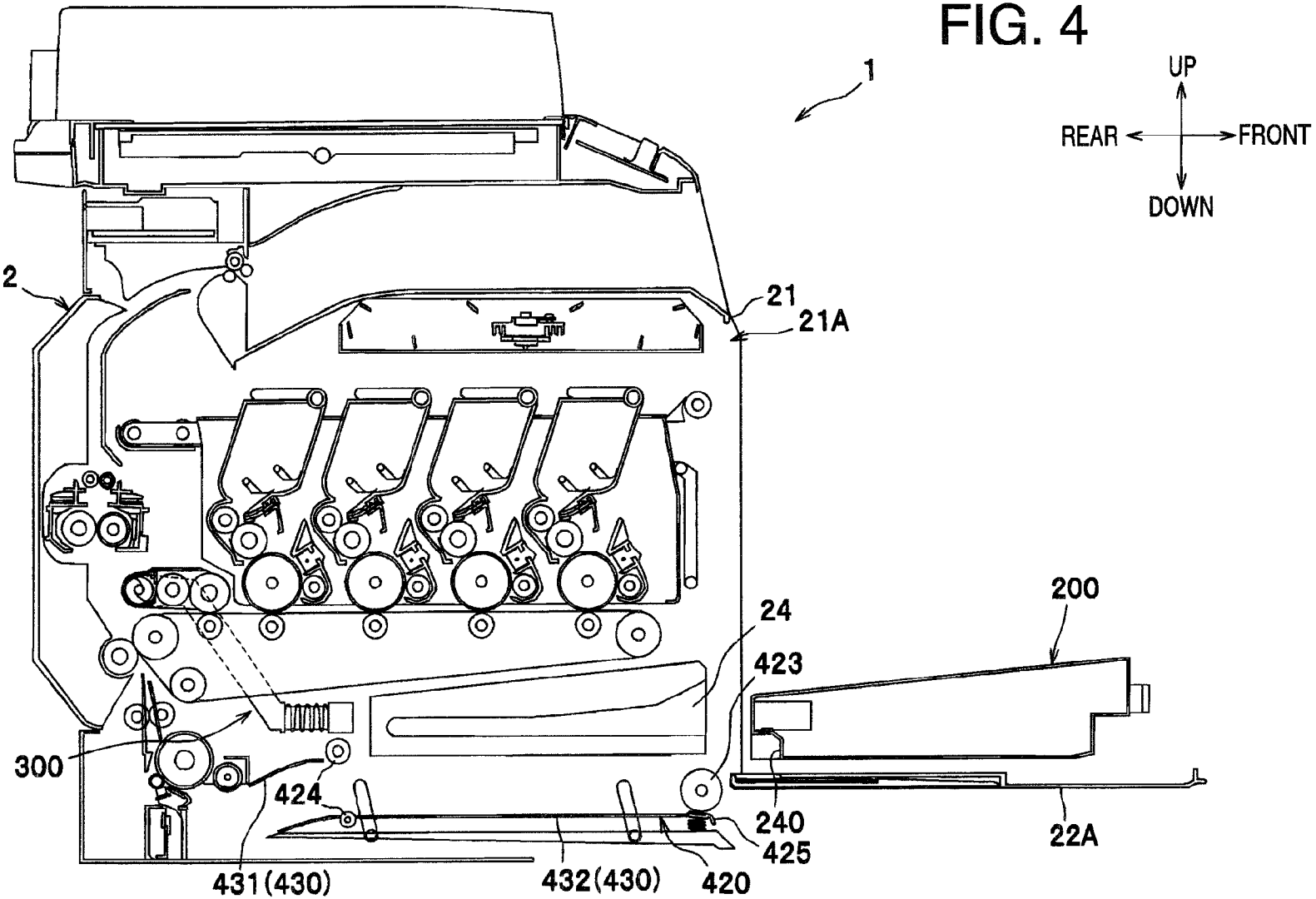
FIG. 4 is a cross-sectional side view of the MFP with a waste toner container removed out of the chassis of the MFP according to the embodiment of the present invention.

The waste toner container 200 accommodates waste toner and is detachably attached to the chassis 2 through the opening 21A and to the connector 300 (see FIG. 4). When attached, the waste toner container 200 is set in a lower position with respect to the intermediate transfer belt 91 on an opposite side from the photosensitive drums 71A. In other words, the waste toner container 200 and the photosensitive drums 71A are arranged in positions opposite from each other across the intermediate transfer belt 91 (see FIG. 1).

As shown in FIG. 6A, the waste toner container 200 is formed to have a trapezoidal wedge-like cross-section having an upper plane 210, which faces the second plane 912 of the intermediate transfer belt 91 and extends there-along, and a lower plane 220, which extends in parallel with the first plane 911 of the intermediate transfer belt 91. More specifically, the upper plane 210 is inclined upwardly toward front with a rear end thereof being lower than a front end thereof. A front side of the waste toner container 200 comes in the vicinity of the driving roller 94 inside the intermediate transfer belt 91 and extends in parallel with the front cover 22A (see FIG. 1) when the waste toner container 200 is settled in the cassis 2. Further, the waste toner container 200 is formed to have the joint 230 on a rear side thereof (see FIG. 8A). The rear side of the waste toner container 200 is further formed to have recesses 240, which accommodate roller parts of conveyer rollers 424 (see FIG. 4) in the second feeding path 420, to avoid interference between the waste toner container 200 and the conveyer rollers 424. The second feeding path 420 and the conveyer rollers 424 will be described later in detail.

Further, the waste toner container 200 is formed to have a pair of guide pins 250 (see FIGS. 8A, 8B), which project outwardly, on each of a right side surface and a left side surface of the waste toner container 200. As the waste toner container 200 is installed in the chassis 2 through the opening 21A, the guide pins 250 are inserted in guide grooves 24 (see FIG. 4), which are formed on left side and right side inner surfaces, and the waste toner container 200 is smoothly guided to a position, in which the waste toner container 200 is attached to the connector 300. The guide grooves 24 are formed to have height thereof to be smaller in an area closer to the rear of the chassis 2 and greater in an area closer to the front of the chassis 2 so that the guide pins 250 are more easily received in the guide grooves 24 in the area closer to the front.

Furthermore, the waste toner container 200 is formed to have ribs 270 (see FIG. 8B), which protrude downwardly from an outer surface of the lower plane 220 and extend along the front-rear direction, when installed in the chassis 2. The ribs 270 are formed to face the second feeding path 420, when the waste toner container 200 is installed, and serve as a part of a sheet guide 430 (an upper guide 431) to guide the sheet being carried in the second feeding path 420. In other words, the ribs 270 form a part of the second feeding path 420.

The waste toner container 200 is further formed to have a handle 280 (see FIG. 8B), which can be grabbed to be handled by a user, on the front side thereof.

Figure 5:
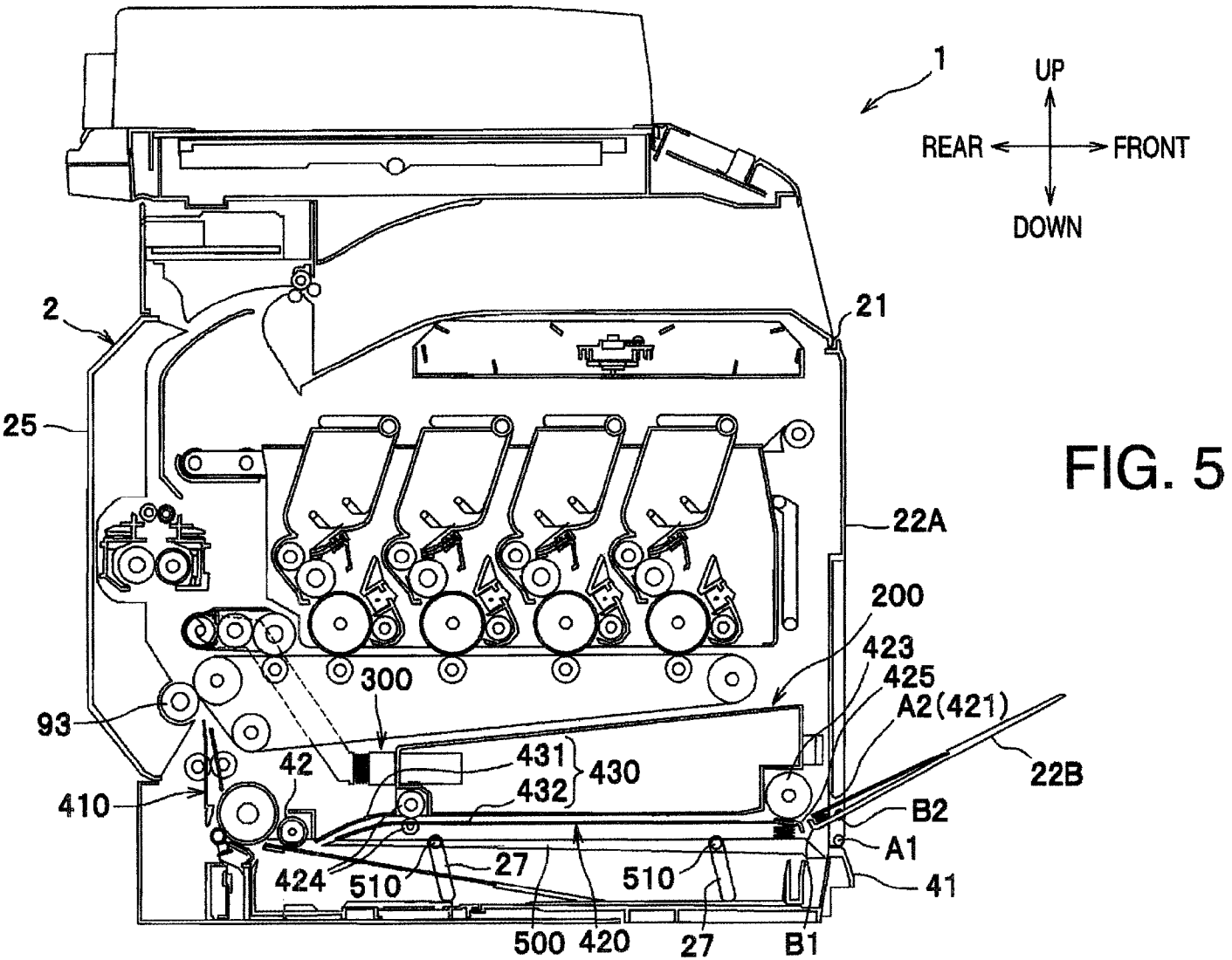
FIG. 5 is a cross-sectional side view of the MFP with an external feed tray in an open position in the MFP according to the embodiment of the present invention.

The second feeding path 420 is formed in between the waste toner container 200 and the sheet-feed tray 41 (see FIG. 5). The second feeding path 420 is a path for a externally-supplied sheet and extends from the front side 21 toward the rear side 25 of the chassis 2 along the lower plane 220 of the waste toner container 200. The second feeding path 420 merges into a first feeding path 410, which ranges between the first feed roller 42 and the secondary-transfer roller 93.

More specifically, in the second feeding path 420, the external-sheet inlet 421, the sheet guide 430, a second feed roller 423, and the conveyer rollers 424 are provided. The sheet guide 430 extends in a range between the external-sheet inlet 421 and the first feed roller 42. The sheet is conveyed by the second feed roller 423 and the conveyer rollers 424 from the external-sheet inlet 421 to the vicinity of the first feed roller 42 along the second feeding path 420 in the sheet guide 430 and further fed in the first feeding path 410.

The second feed roller 423 is a driving and separator roller to separate one of the sheets P inserted through the external-sheet inlet 421 from the others and convey the separated sheet P further in the second feeding path 420. The sheet P is separated by the second feed roller 423 in cooperation with a separator pad 425, which is arranged in an opposite position from the second feed roller 423 across the second feeding path 420. The second feed roller 423 is arranged in a position within the second feeding path 420 closer to the front with respect to the waste toner container 200 and in a horizontally (i.e., in the direction of installation and removal of the waste toner container 200) overlapping position at least partially with the waste toner container 200.

The sheet guide 430 includes an upper guide 431 and a lower guide 432 being arranged in a lower position with respect to the upper guide 431 (see FIG. 5). The upper guide 431 and the lower guide 432 are arranged to have clearance therebetween for the externally-supplied sheet P to pass therethrough.

The upper guide 431 is formed to extend in a range between a position in vicinity of the first feed roller 42 and a position in vicinity of a front end of the connector 300. Lateral (right and left) ends of the upper guide 431 are fixed to inner lateral surfaces of the chassis 2. Further, whilst the waste toner container 200 is arranged in a front position with respect to a front end of the upper guide 43, the ribs 270 formed on the outer surface of the lower plane 220 of the waste toner container 200 serve as a part of the upper guide 431.

The lower guide 432 is formed to extend in a range between a position in vicinity of the external-sheet inlet 421 and a position in the vicinity of the first feed roller 42. In the lower guide 432, a lower one of the conveyer rollers 424 is rotatably arranged at a rear side position. The lower guide 432 is supported by a base 500, which is vertically movable with respect to the chassis 2. Accordingly, the lower guide 432 is vertically movable along with the lower conveyer roller 424 with respect to the chassis 2 and the upper guide 431.

The pair of conveyer rollers 424 include a driving roller, which is rotated by driving force transmitted from a motor (not shown), and a driven roller, which is rotated by rotation of the driving roller. In the MFP 1, either of the driving roller or the driven roller may be arranged as the lower conveyer roller 424. However, when the driven roller is arranged as the lower conveyer roller 424, which is movable along with the lower guide 432, arrangement to reverse transmission of the driving force for the driving roller may become more complicated in consideration of motion paths of movable parts than arrangement of the driven roller, which does not require the transmission path of the driving force. Therefore, it may be preferable that the driven roller is arranged as the lower conveyer roller 424 in order to simplify the configuration in the second feeding path 420.

The base 500 is provided with pairs of projections 510, which are slidable in slider grooves 27. The slider grooves 27 are pairs of grooves, which are formed in the lateral inner surfaces of the chassis 2. The projections 510 and the slider grooves 27 are substantially tightly engaged with each other to allow the base 500 to be movable along the slider grooves 27 when external force is applied to the base 500 and maintained at the position when the base 500 is released from the external force.

Further, the base 500 supports the second feed roller 423 rotatably and the separator pad 425 resiliently via a spring (unsigned) at a position in vicinity of a front end of the base 500. In other words, the second feed roller 423 and the separator pad 425 are arranged on the lower guide 432 to be movable there-along.

Thus, the second feed roller 423 and the separator pad 425 are movable to lowered positions than operable upper positions, in which the second feed roller 423 and the separator pad 425 can feed the sheet P for a print operation, along with the lower guide 432. In this regard, when the MFP 1 is operable to print the image on the sheet P inserted through the external-sheet inlet 421, the second roller 423 is in the position to at least partially horizontally overlap the waste toner container 200 (see FIG. 1). Therefore, when, for example, a used waste toner container 200 is exchanged with an unused waste toner container 200, the second feed roller 423, which may otherwise interfere with the exchanged waste toner containers 200, can be moved out of a course for the waste toner containers 200 to the lowered position. Accordingly, the waste toner container 200 can be removed out of and installed in the chassis 2 through the space, which is normally occupied by the second feed roller 423 during the operable period, and through the opening 21A yielded to the waste toner container 200.

Meanwhile, the slider grooves 27 are formed in the inner surfaces of the chassis 2 in positions, which face the sheet-feed tray 41 when the sheet-feed tray 41 is installed in the chassis 2. In particular, each slider grooves 27 is formed to have an upper end thereof in vicinity of an upper edge of the sheet-feed tray 41 and a lower end thereof in vicinity of a lower edge of the sheet-feed tray 41. When the sheet-feed tray 41 is removed out of the chassis 2 (see FIG. 3), space having been occupied by the sheet-feed tray 41 becomes open to accept the base 500 along with the second feed roller 423 and the lower guide 432, and no additional space to accept the base 500 is required. Therefore, the MFP 1 can be downsized specifically in height thereof.

According to the present embodiment, the slider grooves 27 are formed in an angled orientation to be closer to the front at the lower sections thereof and closer to the rear at the upper sections thereof.

[Exchanging Waste Toner Containers]

Steps to exchange the waste toner containers 200 will be described hereinbelow. When the waste toner container 200 in the chassis 2 (see FIG. 1) is removed, firstly, the sheet-feed tray 41 is removed out of the chassis 2 (see FIG. 3). Secondly, the base 500 is pressed downward, for example, at the front end thereof. Accordingly, the second feed roller 423 is lowered and moved out of the course of the waste toner container 200. Thirdly, the front cover 22A is rotated to the open position (see FIG. 4), and the waste toner container 200 can be pulled frontward to be removed out of the chassis 2. When the waste toner container 200 is newly installed in the chassis 2, the above-described steps are conducted in a reversed order.

When the waste toner container 200 is removed out of the chassis 2, as shown in FIG. 4, an upper front part of the second feeding path 420 is exposed to be connected with the space to be occupied by the waste toner container 200. Further, with the lower guide 432 in the lowered position than the operable upper position, clearance between the lower guide 432 and the upper guide 431 is enlarged. Therefore, a user can access the second feeding path 430 easily through the opening 21A, for example, to remove the sheet P when the sheet P is jammed in the second feeding path 420.

According to the configuration described above, with the second feed roller 423 being movable to the lowered position, the waste toner container 200 can be easily removed out of and installed in the chassis 2 whilst the second feed roller 423 can be arranged on the same side with the opening 21A, through which the waste toner container 200 is removed and installed, within the chassis 2. Further, the second feed roller 423 is arranged in the position within the second feeding path 420 closer to the front with respect to the waste toner container 200 and in a horizontally (i.e., in the direction of installation and removal of the waste toner container 200) overlapping position at least partially with the waste toner container 200. Accordingly, the chassis 2 of the MFP 1 can be downsized in the height thereof.

According to the configuration described above, the second feed roller 423 and the lower guide 432 can be moved to the space, which has been occupied by the sheet-feed tray 41; therefore, no additional space to accept the second feeding roller 423 and the lower guide 432 is required. Therefore, the MFP 1 can be downsized specifically in height thereof.

According to the configuration described above, the second feed roller 423 serves as a driving and separator roller, which separates one of the sheets P inserted through the external-sheet inlet 421 from the others and convey the separated sheet P further in the second feeding path 420. Therefore, unlike an MFP, in which a separator roller is omitted and a single sheet may be fed at a time, a plurality of sheets P can be set in the external feed tray 22B in advance to be fed continuously in the image forming unit 5.

According to the configuration described above, the second feed roller 423 and the separator pad 425 are arranged on the base 500 to be movable along with the lower guide 432. Therefore, positional relation between the second feed roller 423 and the separator pad 425 can be steadily maintained, and separation performance of the second feed roller 423 and the separator pad 425 to steadily separate the lowermost sheet P from the other sheets in the external feed tray 22B can be maintained.

According to the above configuration, the ribs 270 formed on the outer surface of the lower plane 220 of the waste toner container 200 serve as the guide for the sheet P in the second feeding path 420. Therefore, when the waste toner container 200 is removed out of the chassis 2, the second feeding path 420 is exposed to be accessible through the opening 21A. Accordingly, when the sheet P is stuck in the second feeding path 420, the user can access the second feeding path 420 simply by removing the waste toner container 200 out of the chassis 2 to remove the jammed sheet.

According to the above configuration, the drawer 80 holding the processing cartridges 70 is removable through the opening 21A. Therefore, when exchange of the processing cartridges 70 is required, the user can access the processing cartridges 70 from the same side of the chassis 2 as the side, from which the user accesses the waste toner container 200 and the external-sheet inlet 421. Thus, the user's convenience for handling the MFP 1 is improved.

According to the above configuration, the waste toner collected by the cleaner device 100 is conveyed sideward by the auger 130 to the right. The waste toner is further carried to the waste toner container 200 by the connector 300, which is arranged in the clearance 2A formed on the right side of the intermediate transfer belt 91. Therefore, the waste toner can be efficiently carried in a shorter distance from the cleaner device 100 to the waste toner container 200. With the minimum configuration to carry the waste toner, the MFP 1 can be downsized.

According to the above configuration, the joints 230, 330 are arranged in the positions to oppose to each other in line in the installation/removal direction of the waste toner container 200. Accordingly, the structure of the connector 300 can be simplified compared to a connector with joints being arranged to oppose to each other in right-left direction, which is perpendicular to the installation/removal direction of the waste toner container 200.

According to the above configuration, the joints 230, 330 are arranged outside the width of the sheet P being carried in the second feeding path 420. Accordingly, even if the waste toner leaks through the joints 230, 330, the toner may not necessarily fall on the sheet being carried, and the sheet P is prevented from being ruined by the leaked toner.

According to the above configuration, when the joint 230 is detached from the joint 330, the sealers 231, 331 are automatically moved in the positions to cover the openings 232, 332. Thus, fall of the toner from the openings 232, 332 is prevented. Further, the connector 300 is efficiently handled by the automatic closing/opening structure of the sealers 231, 331. For example, compared to joints having sealers, which are manually moved by separately provided manipulation members, the structure of the connector 300 in the above embodiment is more simplified.

According to the above configuration, the sheet P being carried by the first feed roller 42 becomes in contact with the third plane 913 of the intermediate transfer belt 91 before the sheet P enters the nipped position between the intermediate transfer belt 91 and the secondary-transfer roller 93. Therefore, the electrical discharge between the third plane 913 and the sheet P can be reduced.

According to the above configuration, with the intermediate transfer belt 91 having the wedge-shaped cross-section and the waste toner container 200 having the wedge-shaped cross-section, which are arranged in the vertically overlapping positions to substantially form a rectangular solid, the space inside the chassis 2 is efficiently used. Accordingly, the chassis 2 of the MFP 1 can be downsized in the height thereof.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 9:
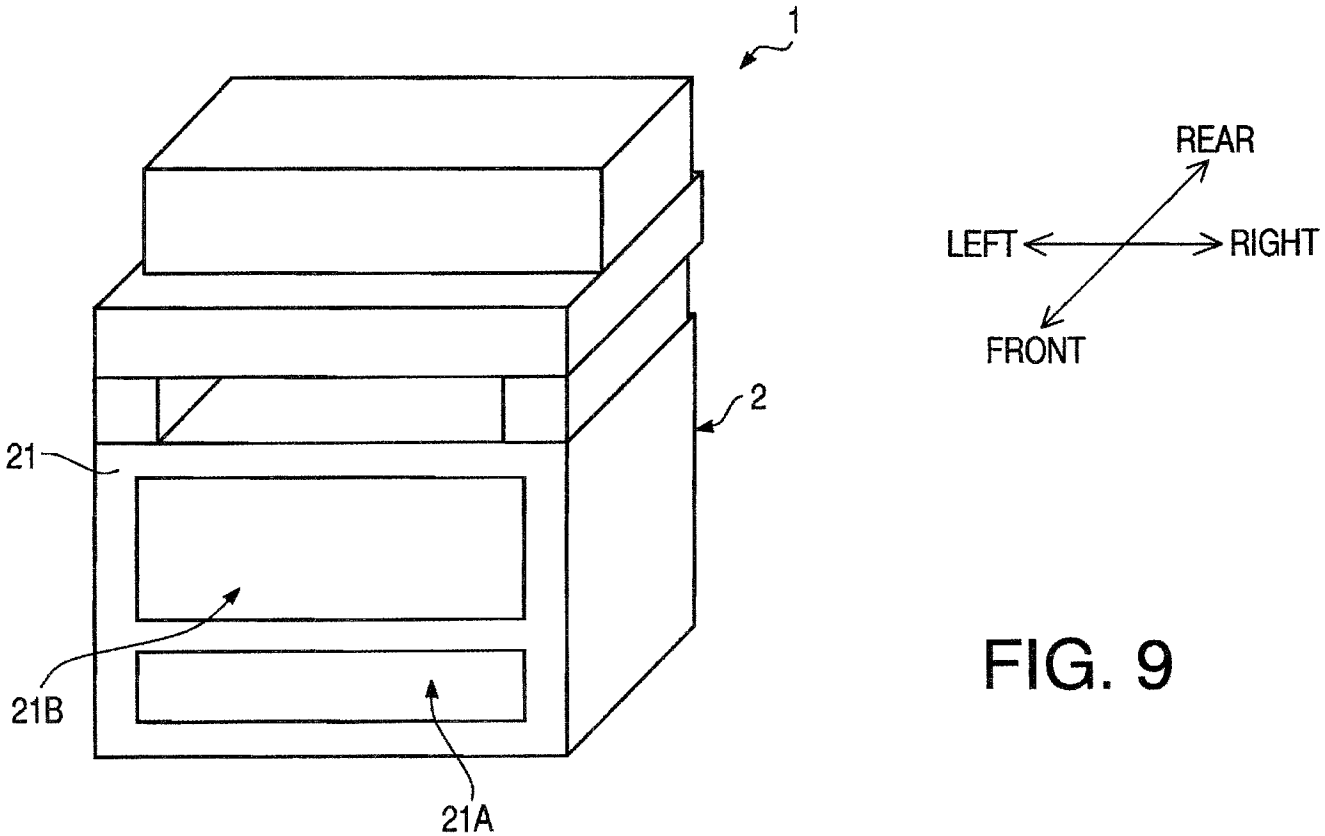
FIG. 9 is a diagram to illustrate two separately-formed openings for the waste toner container and for the drawer in a front side of the MFP according to an embodiment of the present invention.

For example, although in the above embodiment, the single opening 21A to allow the installation and removal of both the drawer 80 and the waste toner container 200 is formed. However, an opening 21A for the drawer 80 and a different opening 21B (see FIG. 9) for the waste toner container 200 may be separately formed, and covers (not shown) to respectively cover/uncover the two openings 21A, 21B may be provided.

In the embodiment described above, solely a part of the sheet guide 430 (i.e., the lower guide 432) is vertically movable, and the other of the sheet guide 430 (i.e., the upper guide 431) is fixed to the inner surfaces of the chassis 2. However, the sheet guide 430 including the upper guide 431 and the lower guide 432 may be vertically movable. Further, in the embodiment described above, the ribs 270 in the waste toner container 200 serve as a part of the upper guide. However, the ribs 270 may not necessarily be formed to guide the sheet P. Instead, the entire lower plane 220 may serve as the part of the upper guide.

For another example, the side, in which the opening 21A and the external-sheet inlet 421 are formed, may not necessarily be the front side, but may be the right or the left side. Further, the photosensitive drums 71A may be replaced with, for example, photosensitive belts.

The structures of the cleaner device 100 and the connector 300 may not be limited to those described above. For example, a cleaner device 100 without the collecting roller 120 may be used. Alternatively or additionally, a connector 300 without the spring auger 320 may be employed. Furthermore, a connector 300 may be provided with a cover being slidable along a plane, in which the opening is formed.

Further, the primary-transfer rollers 92 may be replaced with, for example, conductive brushes or conductive blade springs, as long as the primary-transfer members are capable of bearing the applied transfer bias.

In the embodiment described above, the second feed roller 423 being a driving roller separates the sheet P in cooperation with the separator pad 425. However, for example, the second feed roller may separate the sheet P in cooperation with a paired driven roller. Further, the second feed roller may not necessarily be a driving roller but may be a driven roller, which can be driven by a paired driving roller.

Further, for example, the auger 130 with the spiral may be replaced with a spring auger. For another example, the waste toner container 200 may not necessarily be installed and removed in the horizontal direction, but may be installed and removed in an angled direction with respect to the horizontal direction.

The embodiment described above may not necessarily be applied to a multicolor MFP, but may be employed in, for example, a printer and a copier. Further, the sheet may not necessarily be paper but may be, for example, an OHP sheet.

What is claimed is:

1. An image forming apparatus configured to form an image on a recording sheet, comprising:

a chassis having an opening, the opening being formed on a first side of the chassis;

a drawer configured to hold a plurality of photosensitive members therein in line and to be slidably installed in the chassis through the opening and movable between a first position and a second position in the chassis, the plurality of photosensitive members being configured to carry toner images;

an intermediate transfer belt unit including an endless belt, the endless belt rolling in a predetermined rolling direction and having a surface which faces the plurality of photosensitive members and being configured to have the toner images on the plurality of photosensitive members transferred onto the surface in cooperation with a plurality of primary-transfer members;

a secondary-transfer roller arranged on a second side opposite from the first side within the chassis and configured to transfer the toner images on the surface of the endless belt onto the recording, sheet;

a first feed roller arranged in a vicinity of the second side and configured to convey the recording sheet toward the secondary-transfer roller;

a cleaner device arranged in a position between one of the plurality of photosensitive members being in a most upstream position along the predetermined rolling direction of the endless belt and the second transfer roller, and configured to collect residual toner from the surface of the endless belt and convey the collected residual toner toward an outer side of the endless belt along a widthwise direction;

a waste toner container configured to be removably installed in the chassis and to store the residual toner collected by the cleaner device;

a connector arranged on the outer side of the endless belt along the widthwise direction and connected to the cleaner device, and to which the waste toner container is detachably attached, the connector being configured to convey the residual toner collected by the cleaner device to the waste toner container;

a first feeding path configured to extend in a range between the first feed roller and the secondary-transfer roller; and a second feeding path configured to extend from the first side toward the second side and merge into the first feeding path between the first feed roller and the secondary-transfer roller, the second feeding path including a sheet guide to guide the recording sheet, wherein the sheet guide is movable between an upper position and a lower position.

2. The image forming apparatus according to claim 1, wherein the sheet guide includes a pair of conveyer rollers.

3. The image forming apparatus according to claim 2, wherein the sheet guide includes an upper guide and a lower guide, the lower guide being arranged in a lower position with respect to the upper guide and movable between the upper position and the lower position;

wherein a part of the waste toner container facing the second feeding path, when the waste toner container is installed in the chassis, serves as a part of the upper guide.

4. The image forming apparatus according to claim 3,
wherein one of the pair of conveyer rollers is rotatably attached to the upper guide in a position to at least partially horizontally overlap the waste toner container, and the other one of the pair of conveyer rollers is rotatably attached to the lower guide and movable along with the lower guide.

5. The image forming apparatus according to claim 4,
wherein the part of the waste toner container facing the second feeding path is formed to have a recess, in which the one of the pair of conveyer rollers is accommodated when the waste toner container is installed in the chassis.

6. The image forming apparatus according to claim 1,
wherein the waste toner container is configured to be removably installed in the chassis through the opening.

7. The image forming apparatus according to claim 1,
wherein the waste toner container is configured to be removably installed in the chassis through a different opening, which is formed on the first side of the chassis separately from the opening.

8. The image forming apparatus according to claim 1, further comprising:
a sheet-feed tray, which is configured to be removably installed in lower space in the chassis with respect to the second feeding path,
wherein the sheet guide is movable to the lower space, which is to be occupied by the sheet-feed tray when the sheet-feed tray is installed in the chassis.

9. The image forming apparatus according to claim 1,
wherein the cleaner device is arranged in a horizontally overlapping position at least partially in a same vertical level with the plurality of photosensitive members.

10. The image forming apparatus according to claim 1,
wherein the waste toner container and the connector are respectively provided with mutually attachable joints, which are arranged in positions to align along the predetermined direction of installation and removal of the waste toner container to face each other when the waste toner container is being attached to the connector.

11. The image forming apparatus according to claim 10,
wherein the connector is arranged outside width of the recording sheet being carried in the second feeding path.

12. The image forming apparatus according to claim 10,
wherein each of the joints includes:
a sealer configured to be slidable in the predetermined direction of installation and removal of the waste toner container between a covering position and an uncovering position;
an aperture configured to be covered by the sealer in the covering position and uncovered by the sealer in the uncovering position;
a resilient member configured to resiliently push the sealer toward the covering position; and
an end section configured to push the sealer against the resiliency of the resilient member when the waste toner container is attached to the connector.

13. The image forming apparatus according to claim 1,
wherein the endless belt is extended to form a cross-section of a triangle, having:
a first plane, which has a first end and a second end, and extends horizontally to face the at least one photosensitive member and the cleaner device;
a second plane, which has a first end and a second end, the second plane extending from the first end of the first plane downwardly in an inclined angle with respect to the first plane;
a third plane, which has a first end and a second end, the third plane extending from the second end of the first plane downwardly in an inclined angle with respect to the first plane, the first end of the third plane being connected with the second end of the second plane;
wherein the first ends of the first plane, the second plane, and the third plane are closer to the first side of the chassis and the second ends of the first plane, the second plane, and the third plane are closer to the second side of the chassis; and
wherein the endless belt and the first feed roller are arranged in positions to have the recording sheet conveyed by the first feed roller to become in contact with the third plane of endless belt.

14. The image forming apparatus according to claim 13,
wherein the waste toner container is formed to have an upper plane, which faces and extends along the second plane of the endless belt, and a lower plane, which extends in parallel with the first plane of the endless belt when the waste toner is installed in the chassis.

15. The image forming apparatus according to claim 1,
wherein the intermediate transfer belt unit and the waste toner container are arranged in at least partially vertically overlapping positions mutually.

16. The image forming apparatus according to claim 1, further comprising a fixing unit,
wherein the drawer is arranged in a horizontally overlapping position at least partially in a same vertical level with the fixing unit.

17. The image forming apparatus according to claim 1,
wherein the intermediate transfer belt unit includes a driving roller and a driven roller; and
wherein the cleaner device is arranged in a vertically overlapping position at least partially with the driven roller.

18. The image forming apparatus according to claim 1,
wherein the connector includes a coil spring.

19. The image forming apparatus according to claim 1,
wherein the first position is a position, in which the drawer is installed through the opening to be settled in the chassis; and
wherein the second position is a position, in which the drawer is removed out of the chassis through the opening.

20. The image forming apparatus according to claim 1,
wherein the waste toner container is arranged in a horizontally non-overlapping position with respect to the sheet guide, in which the waste toner container does not overlap the sheet guide horizontally, when viewed along a direction orthogonal to the widthwise direction.

* * * * *